US005217538A

United States Patent [19]

Buchholz et al.

[11] Patent Number: 5,217,538

[45] Date of Patent: Jun. 8, 1993

[54] APPARATUS AND RELATED METHOD FOR THE REMOVAL OF LABELS AND FOIL TAGS ADHERING TO CONTAINERS, IN PARTICULAR, TO BOTTLES

[75] Inventors: Rainer Buchholz; Rudolf Zodrow, both of Düsseldorf, Fed. Rep. of Germany

[73] Assignee: KHS ETI-TEC Maschinenbau GmbH, Erkrath, Fed. Rep. of Germany

[21] Appl. No.: 668,301

[22] Filed: Mar. 13, 1991

[30] Foreign Application Priority Data

Mar. 13, 1990 [DE] Fed. Rep. of Germany ..... 4007958

[51] Int. Cl.[5] ..... B08B 3/14; B08B 9/20; B08B 9/34

[52] U.S. Cl. ..... 134/25.4; 134/10; 134/32; 134/34; 134/36; 134/104.4; 134/148; 134/153

[58] Field of Search ..... 134/25.4, 10, 18, 32, 134/34, 36, 104.4, 137, 142, 148, 153

[56] References Cited

U.S. PATENT DOCUMENTS

| | | | |
|---|---|---|---|
| 2,573,169 | 10/1951 | Gerlach et al. | 134/104.4 |
| 3,946,750 | 3/1976 | Fischer et al. | 134/104.4 |
| 4,108,774 | 8/1978 | Babunovic et al. | 134/104.4 |
| 4,325,775 | 4/1982 | Moeller | 134/104.4 |

FOREIGN PATENT DOCUMENTS

| | | | |
|---|---|---|---|
| 3508150 | 10/1985 | Fed. Rep. of Germany . | |
| 8630471 | 10/1985 | Fed. Rep. of Germany . | |
| 1186182 | 4/1970 | United Kingdom | 134/25.4 |

*Primary Examiner*—Theodore Morris
*Assistant Examiner*—Saeed T. Chaudhry
*Attorney, Agent, or Firm*—Nils H. Ljungman and Associates

[57] ABSTRACT

An apparatus for the removal of labels and foil tags adhering at different levels to containers, in particular, bottles. The bottles are gripped axially between a rotary plate and a gripping head on the circumference of a turntable, each of these is a gripping space. Corresponding to each gripping space, there are high-pressure nozzles located on an inner circumference of the turntable relative to the bottles. Jets of fluid from the nozzles are directed approximately tangentially to the surface of each bottle, so that the jets remove the label and the foil tag in a stripping process, and transport the labels and foil tags radially outward to a collector, which collector is equipped with a separator to separate the labels and foil tags from one another. The removal of labels applied with adhesive is facilitated if there is an anti-adhesive layer on the label between the adhesive layer and the label.

14 Claims, 8 Drawing Sheets

APPARATUS AND RELATED METHOD FOR THE REMOVAL OF LABELS AND FOIL TAGS ADHERING TO CONTAINERS, IN PARTICULAR, TO BOTTLES

BACKGROUND OF THE INVENTION

1. Field of the Invention

The present invention relates to apparatus for removing labels from reusable containers, in particular, reusable bottles to which adhesive labels have been attached, and the method therefor.

2. Background Information

In order to be able to reuse the bottles, it is necessary to clean the bottles both inside and outside before they are refilled. Such a cleaning is done by a washing process that is also used to remove glued-on labels and foil tags from the bottle surface. Solvents, some of which are aggressive, are generally added to the washing fluid for the successful removal of the labels and, in particular, the foil tags. After use, the washing fluid contains pieces of the labels and foil tags, as well as the solvents, and it is necessary to use complex and expensive treatment processes on the washing fluid to produce as little pollution as possible. Attempts have long been made to find alternatives to solve this problem of washing fluid treatment for use with returnable bottles having labels and foil tags.

Labels and foil tags have heretofore been glued onto the bottles by adhesive applied to the reverse side of the label. More recently, labels having a media activated substance on their reverse side have been used, as seen in Federal Republic of Germany Laid Open Patent Application No. DE 35 08 150 A1, entitled "Etikett und Verfahren und Vorrichtung zum Aufbringen eines Etiketts sowie Verfahren und Vorrichtung zum Ablösen eines Etiketts." In this publication, the labels adhering to a bottle by a media activated substance can be removed from the bottle after repeated activation of the substance by jets of, e.g., compressed air or water, or by brushing. The substance of the labels or foil tags remains intact when removed in this manner. This type of removal of labels and foil tags from the bottles has never been successful in actual practice.

Another apparatus for the removal of labels and foil tags adhering to bottles can be seen in Federal Republic of Germany Utility Model No. DE-GM 86 30 471 entitled "Bezeichnung des Gegenstandes Vorrichtung zum Mechanischen Ablösen von Etiketten," which apparatus is designed in the manner of a conventional turntable in a labelling station, i.e., a labelling station in which the bottles are axially gripped between a rotary plate and a gripping head. The mechanical removal elements of the apparatus are rotating brushes which act on the labels of the bottles gripped onto the turntable. So far, this apparatus has never been used in actual practice, either.

OBJECT OF THE INVENTION

The object of the invention is the use of such an apparatus to improve both the removal of the labels and foil tags from the bottles and from the vicinity of the turntable, as well as providing a means to guarantee the separation of the various labels and foil tags.

SUMMARY OF THE INVENTION

The present invention relates to an apparatus for the removal of labels and foil tags adhering to containers, in particular, to bottles of varying heights, and the method therefor. The apparatus consists of a turntable having an inlet for placing the bottles onto the turntable and an outlet for removing the bottles from the turntable, each of these is a gripping space. The bottles are axially braced between driven rotary plates and gripping heads located about the outer circumference of the turntable. Removal elements which act to remove the labels and foil tags from the gripped bottles are located on an inner circumference of the turntable relative to the bottles.

The object of the invention is achieved by means of an apparatus of the type described above, in which the removal elements are designed as high-pressure nozzles, whose essentially radially outward jets strike the surface of the bottle that is to be turned, at least approximately tangentially, so that as the bottle rotates, its label and foil tag arrive in the vicinity of the jets with their exposed leading edges being turned towards the jets. For labels and foil tags located at various heights on the bottles, there is a stationary collector apparatus with a separator barrier for the separation of the labels from the bottom section of the bottles and foil tags from the top section of the bottles. The separator barrier is preferably located on the outside periphery of the turntable, and can be adjusted according to the various heights at which the labels and tags are located. The stationary collector apparatus collects the labels and foil tags which are transported radially outward after removal by the jets, and which labels and foil tags then drop downward with gravity into a collection container. The separator is preferably designed as a barrier which is disposed such that foil tags removed from the top section of the bottles, along with the fluid from the jets, move over the top edge of the barrier and may impinge upon an outer limiting wall, and then drop over into a first collection container. The labels removed from the bottom section of the bottles, along with the fluid from the jets, may impinge upon an underside of the barrier and then drop into a second collection container.

In the apparatus according to the invention, the jets remove the labels and foil tags from the surface of the bottles, and simultaneously guarantee that the labels and foil tags are transported radially outward from the vicinity of the turntable to the collector apparatus. The invention takes advantage of the fact that the labels and foil tags are applied to the bottles at different heights, as the separator barrier may be disposed such that the foil tags are transported over the separator barrier and the labels are transported under the separation barrier. The mere fact of the radially outward transport of the labels, in connection with the separator barrier, guarantees the separate discharge of the different labels and foil tags.

The removal of the labels and foil tags by the jets is facilitated if there is a separating agent on the back portion of the labels. The labels can be applied to the bottles by conventional labelling machines using adhesive even if a separating agent is used. The low adherence of the separating agent causes it to act as an anti-adhesive or releasing agent. The amount of adhesive that remains on the bottle surface will essentially depend upon the type of medium being sprayed through the jets. The adhesive that does remain on the bottle surface is, however, not essentially a problem because the bottle always undergoes a subsequent washing process anyway. In this washing process, it is critical that the washing fluid be kept free of labels and foil tags to thus make it easier and less expensive to regenerate the washing fluid. This is also true of the medium being sprayed through the nozzles, e.g., water, from which the labels and foil tags would also need to be removed.

The abstract of Federal Republic of Germany Laid Open Patent Application No. DE 35 08 150 A1, entitled "Etikett und Verfahren und Vorrichtung zum Aufbringen eines Etiketts sowie Verfahren und Vorrichtung zum Ablösen eines Etiketts," appears to give support for the application of anti-adhesives to labels before the labels are glued onto the bottles. The abstract as translated states, "Activating is done before or at the touching of the labels with the objects to be labelled. Before the removal of the labels the substance is, if necessary, activated, so that the labels can be separated from the containers in a simple way."

In the case of labels and foil tags which completely encircle the bottles, the lateral ends of the labels and foil tags overlap one another exposing only one edge. This exposed edge can be struck by the jets head-on. In one embodiment of the invention, the rotary plates are preferably designed for both right-hand and left-hand operation, that is, a clockwise and counter-clockwise sense. In the gripping space of each bottle in such right-hand and left-hand apparatus, there are preferably two sets of high pressure nozzles: one of which operates during right-hand operation and the other of which operates during left-hand operation. Alternatively, one set of nozzles could be moved to facilitate right-hand and left-hand operation.

One aspect of the invention resides broadly in an apparatus for the removal of at least one label from at least one container, the apparatus comprising a nozzle device for emitting a fluid under pressure and impinging the fluid onto the at least one container for at least assisting in the removal of the at least one label from the at least one container. The apparatus also comprises a device for supplying pressurized fluid to the nozzle device, and a device for directing the pressurized fluid from the nozzle device to a position at least partially underneath the at least one label of the at least one container. It further comprises a device for supporting at least one container during removal of the at least one label from the at least one container, and a moving device for producing relative movement between the at least one container and the nozzle device. The label removing apparatus still further comprises an inlet device for supplying labelled containers to be impinged upon by the pressurized fluid from the nozzle device, and an outlet device for removing containers impinged upon by the pressurized fluid from the nozzle device.

Another aspect of the invention resides broadly in an apparatus for the removal of at least one label from at least one container, the apparatus comprising a high pressure nozzle for emitting pressurized fluid for at least assisting in the removal of at least one label from at least one container, and a pump for supplying pressurized fluid to the high pressure nozzle. The apparatus also comprises a device for directing the pressurized fluid from the high pressure nozzle to a position at least partially underneath the at least one label of the at least one container, and a device for supporting the at least one container comprising a gripping head and rotary plate. The label removing apparatus further comprises a moving device for producing relative movement between the at least one container and the high pressure nozzle. The apparatus still further comprises an inlet star wheel for supplying labelled containers to be impinged upon by the pressurized fluid from the high pressure nozzle, and an outlet star wheel for removing containers impinged upon by the pressurized fluid from the high pressure nozzle.

Yet another aspect of the invention resides broadly in an apparatus for the removal of at least one label from at least one container, the apparatus comprising a high pressure nozzle for emitting a pressurized fluid for at least assisting in removal of the at least one label from the at least one container, and a pump for supplying the pressurized fluid to the high pressure nozzle. The high pressure nozzle is disposed to impinge the pressurized fluid at an angle essentially tangential to a forward edge of the at least one label of the at least one container. The label removing apparatus also comprises a device for supporting at least one container comprising a gripping head and rotary plate. A motor device rotates the rotary plate in either a clockwise or counter-clockwise sense. A moving device produces relative movement between the at least one container and the high pressure nozzle. The moving device comprises a turntable device. The turntable device has an interior portion and an exterior portion. The high pressure nozzle is disposed on the interior portion of the turntable device for impinging pressurized fluid upon the at least one label of the at least one container. The device for supporting at least one container is disposed along the outside periphery of the turntable device. The label removing apparatus also comprises a collecting device for collecting the spent fluid and the at least one label from the at least one container, and filtering device for filtering the spent fluid. The collecting device is disposed along the outside periphery of the turntable device. An inlet star wheel supplies labelled containers to be impinged upon by the pressurized fluid from the high pressure nozzle, and an outlet device removes containers impinged upon by the pressurized fluid from the high pressure nozzle.

A further aspect of the invention resides broadly in a method for the use of an apparatus for the removal of at least one label from at least one container, the apparatus comprising the structure of: nozzle device for emitting fluid under pressure for at least assisting in the removal of the at least one label from the at least one container; device for supplying fluid under pressure to the nozzle device; device for directing fluid under pressure from said nozzle device to a position at least partially underneath the at least one label of the at least one container; device for supporting at least one container during removal of the at least one label from the at least one container; moving device for producing relative movement between the at least one container and the nozzle device; inlet device for supplying labelled containers for being impinged upon by fluid under pressure from the nozzle device; and outlet device for removing containers impinged upon by fluid under pressure from the nozzle device, the method comprising the steps of: emitting fluid under pressure from the nozzle device for at least assisting in the removal of at least one label from at least one container; supplying fluid under pressure to the nozzle means; directing fluid under pressure from the nozzle device to a position at least partially underneath the at least one label of the at least one container; supporting the at least one container during removal of the at least one label from the at least one container; producing relative movement between the at least one container and the nozzle device; supplying labelled containers for being impinged upon by fluid under pressure from the nozzle device; impinging fluid under pressure from the nozzle device to a position at least partially underneath the at least one label of the at least one container: removing containers impinged upon by fluid under pressure from the nozzle device.

BRIEF DESCRIPTION OF THE DRAWINGS

The invention is explained in greater detail below with reference to the accompanying drawings, which illustrate one embodiment of the invention.

DESCRIPTION OF THE PREFERRED EMBODIMENTS

Figure 1:
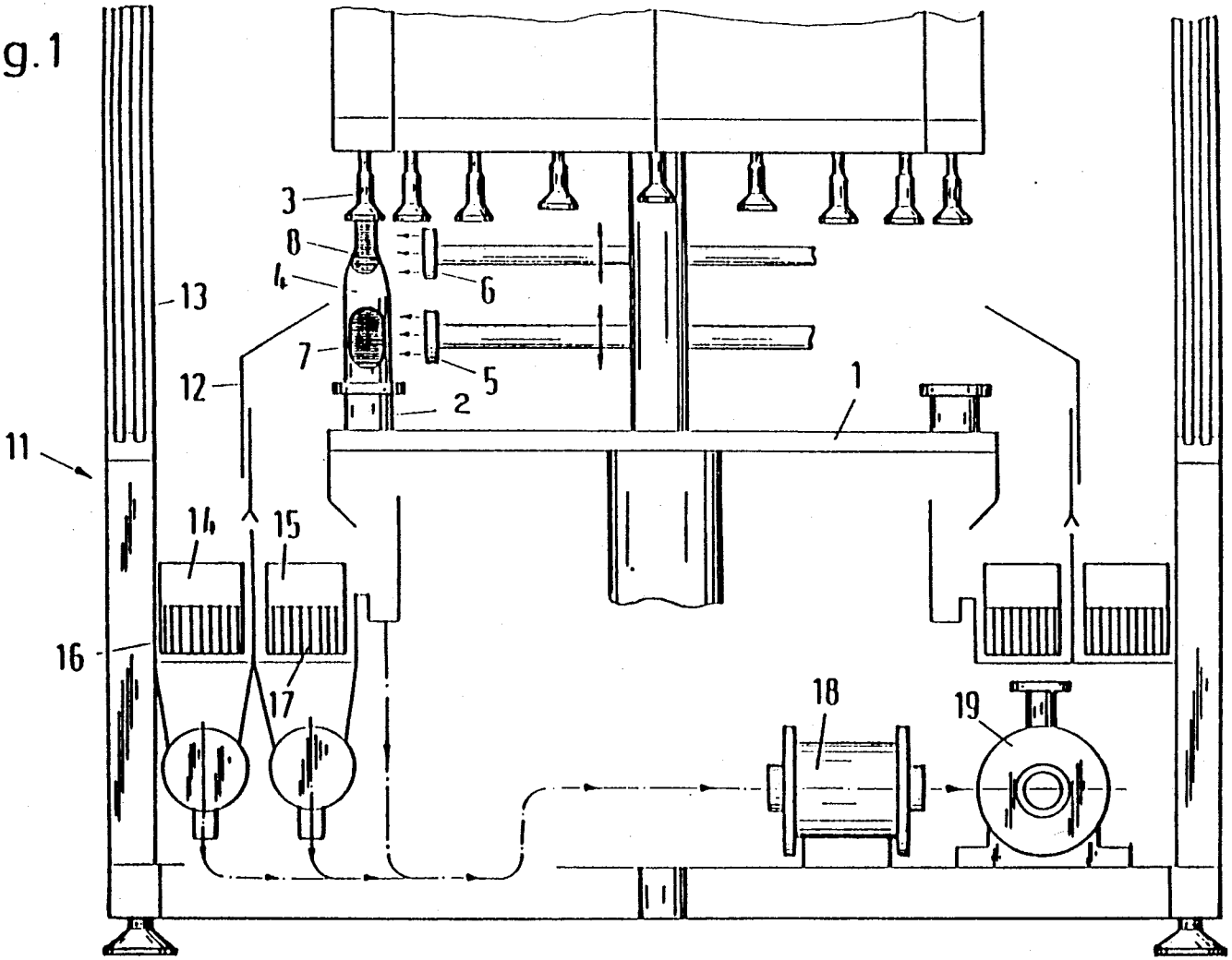
FIG. 1 is a schematic diagram showing a side view of an apparatus for the removal of labels and foil tags adhering to bottles.

The apparatus illustrated in FIGS. 1–5 comprises a turntable 1 with a bottle inlet which may be designed, for example, as an inlet star wheel, and a bottle outlet which may be designed, for example, as an outlet star wheel, described in more detail below. On its outer circumference, the turntable preferably has powered rotary plates 2 and freely-rotating gripping heads 3, between which the bottles 4 are gripped axially. The rotary plates 2 can preferably be switched from right-hand (i.e., clockwise) to left-hand (i.e., counter-clockwise) operation. The turntable 1, on an inner circumference relative to the bottles 4, has high pressure nozzles 5, 6 preferably disposed outwardly towards the bottles 4. Each of the bottles 4 is gripped in a gripped position on the turntable 1. The high pressure nozzles 5, 6 are located at different levels corresponding to the position of a label 7 applied to the body of the bottle and a foil tag 8, applied to the neck of the bottle. The highpressure nozzles 5, 6 can not only be adjusted in terms of height, as indicated by the arrows H, H', but can also be adjusted radially, as indicated by the arrows W, W', so that they strike the labels and foil tags to be removed, as shown in FIG. 1*a*.

Figure 1A:
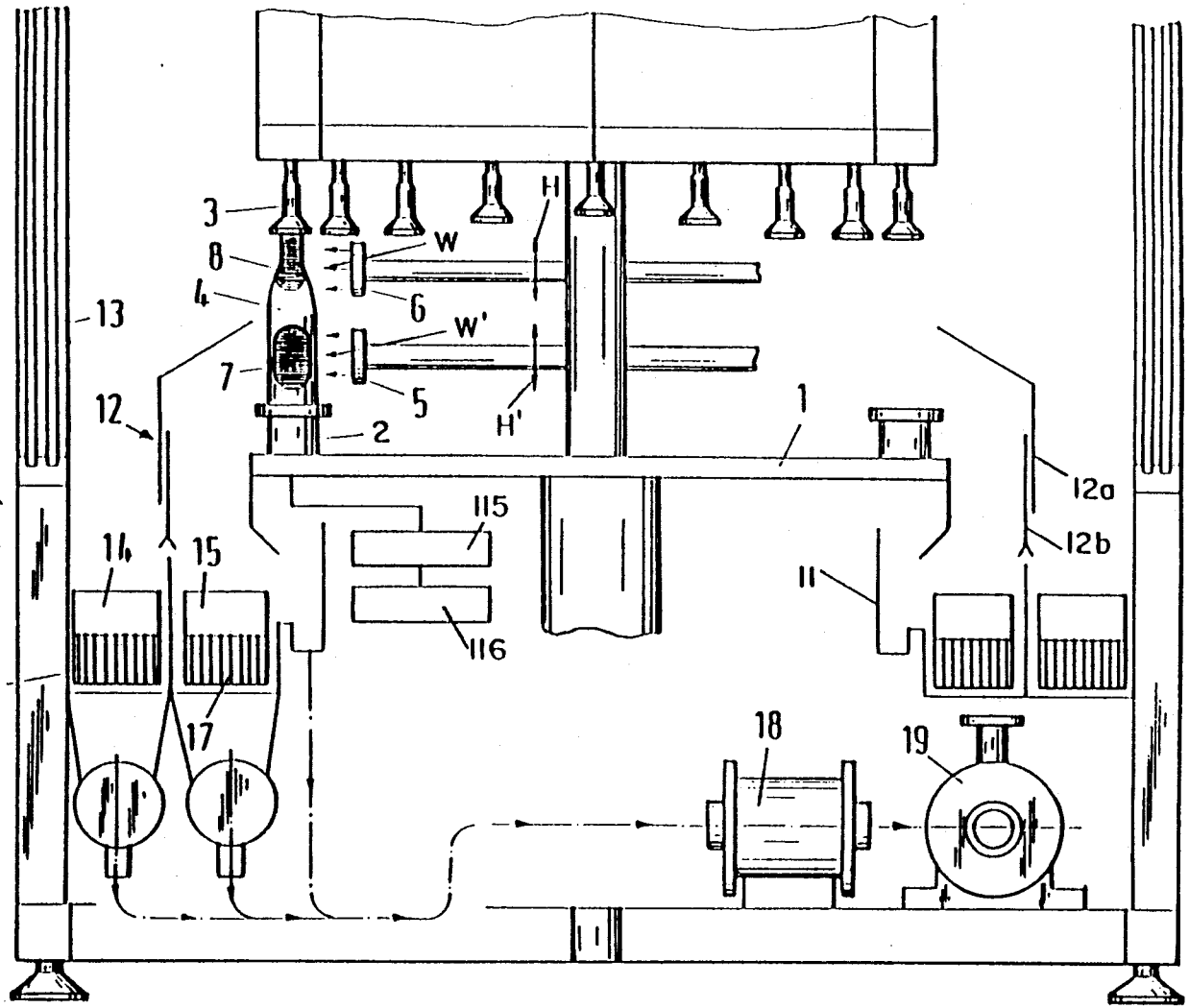
FIG. 1*a* is a second schematic diagram showing a side view of an apparatus for the removal of labels and foil tags adhering to bottles corresponding generally to FIG. 1, with additional structures included therein.

FIG. 1*a* is very similar to FIG. 1, and further shows a bidirectional motor 115, and a control 116 for the bidirectional motor 115, which motor 115 powers the rotary plates 2.

A stationary collector 11 with a two-piece separator barrier 12 having a member 12*b* and a deflector 12*a*. The deflector 12*a* has a portion which abuts member 12*b*. The member 12*b* may remain in a fixed position while the deflector 12*a* may be moved in a sliding manner relative to the member 12*b* along the line of abutment. The deflector 12*a* may be moved vertically along the member 12*b* in order to position the deflector to more effectively separate the labels 7 and foil tags 8 occurring at various heights on bottle 4, and for accommodating bottles 4 of various sizes having labels 7 and foil tags 8 occurring at different heights. Since the foil tags 8 may be found on the top portion of the bottles, and the labels 7 may be found on the bottom portion of the bottles, the deflector 12*a* may be angled to allow foil tags 8 to be transported over the top edge of the deflector 12*a* and the labels 7 to be transported underneath the deflector 12*a*. The correct placement of deflector 12*a* relative to the bottle 4 creates separate paths for the labels 7 and foil tags 8 to follow to the collection containers 14, 15. Thus, the paths created by the separator barrier 12 more effectively guarantee the disposition of the labels 7 and foil tags 8 into separate containers.

Figure 2:
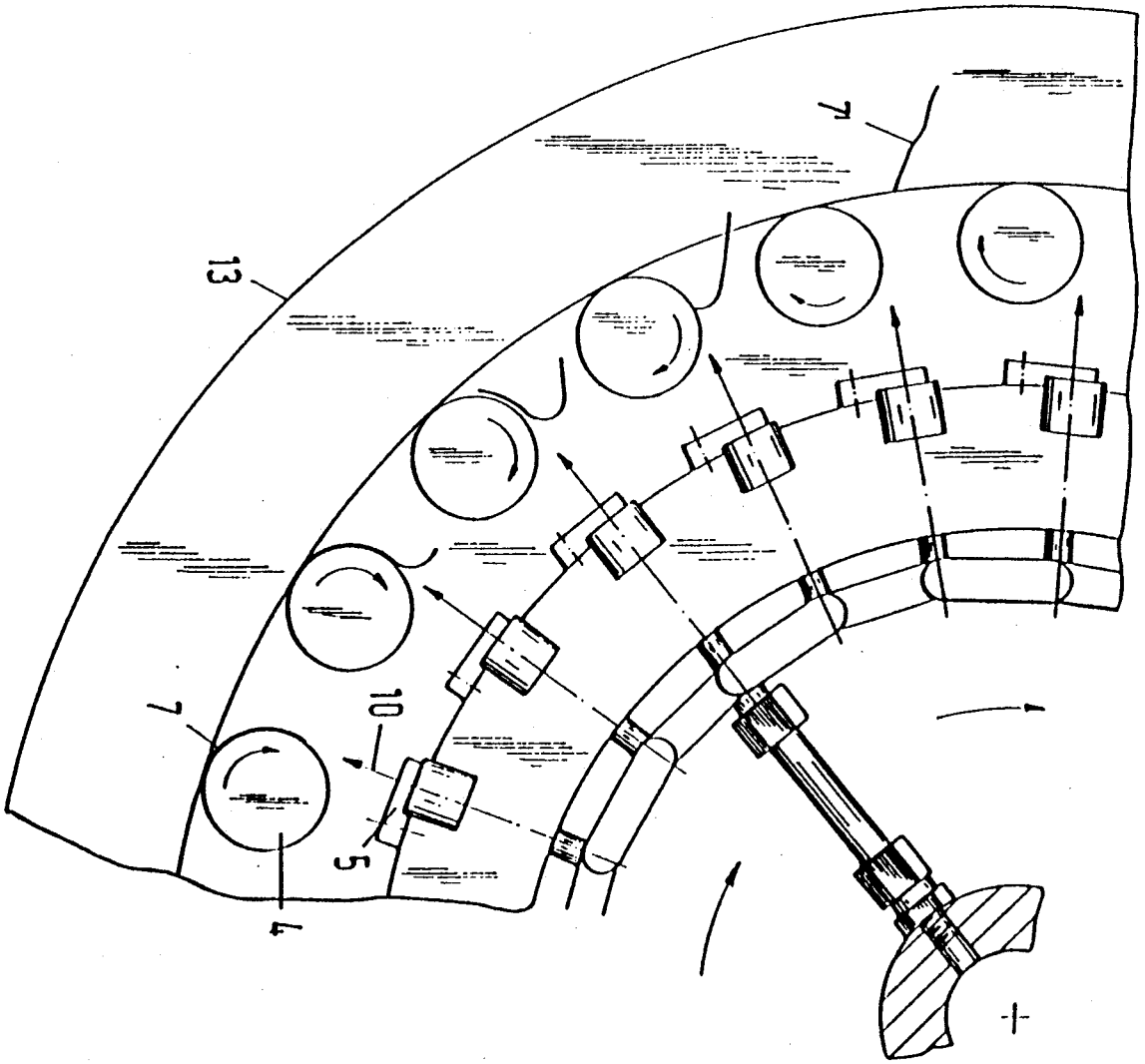
FIG. 2 is a plan view of an enlarged section of the apparatus illustrated in FIG. 1.

As shown in FIG. 2, the jets 10 from the high pressure nozzle 5 are directed tangentially toward the surface of the bottles 4, so that when the bottles 4 turn, the jets face the forward edge of the label 7. Thus, the jets 10 may remove the label 7', as indicated by the various phases as shown in FIG. 2. The labels 7' which have been removed, and the fluid from the jets 10 may impinge upon outer limiting wall 13, and drop into a collection container 15.

Figure 2A:
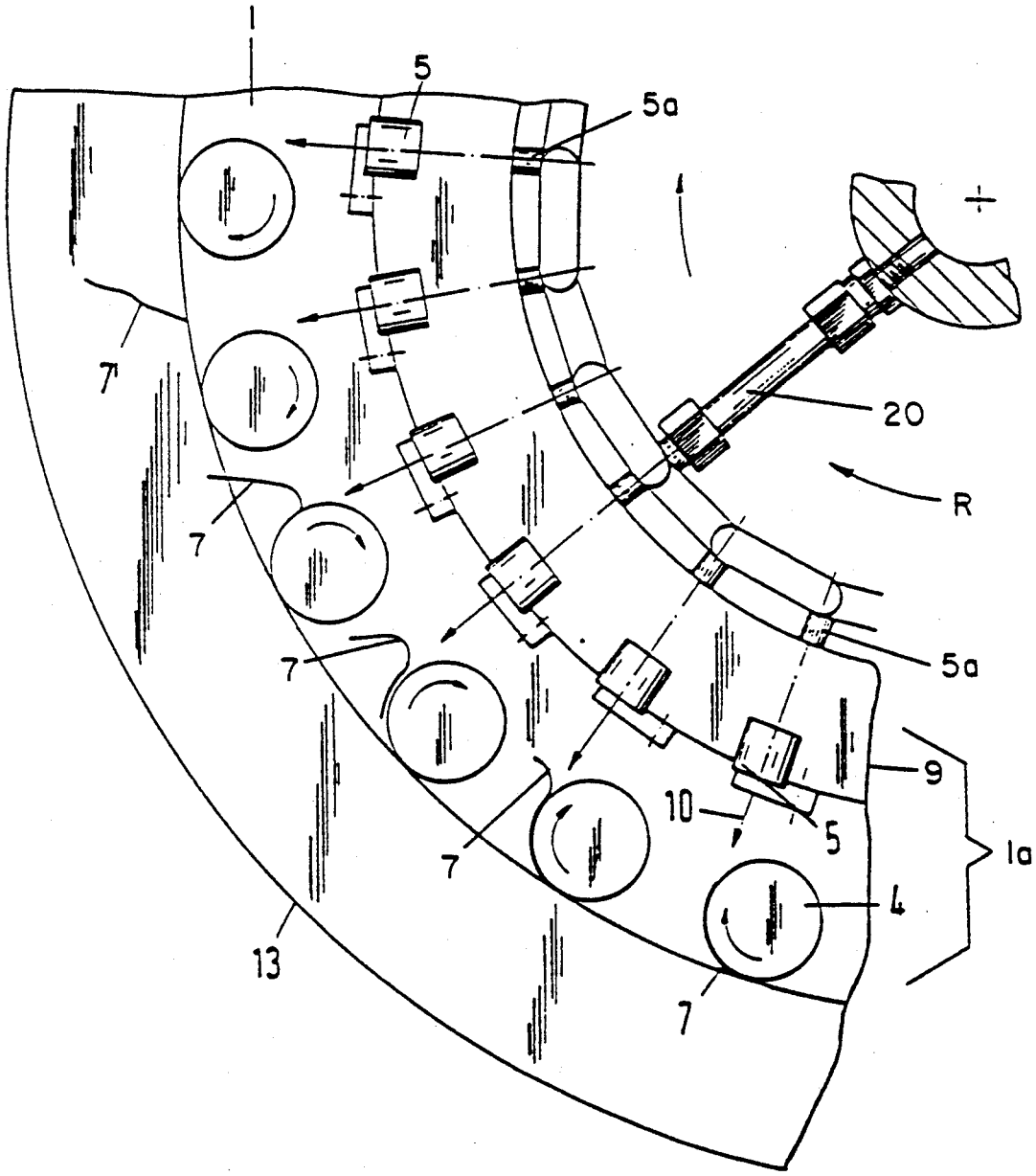
FIG. 2*a* is a second plan view of an enlarged section of the apparatus illustrated in FIG. 1, corresponding generally to FIG. 2, with additional structures included therein.

FIG. 2*a* is very similar to FIG. 2, and further shows a fluid supply line 20 which supplies fluid under pressure to the nozzles 5. The nozzles 5 are disposed in a manifold 9 located on the turntable 1. Each nozzle 5 has a corresponding feeder tube 5*a*, also located in the manifold 9. Motion of the turntable 1 is indicated by arrow R. The manifold 9 is connected to the feeder tubes 5*a* and the fluid supply line 20, whereat fluid under pressure is supplied to the feeder tubes 5*a* from the fluid supply line 20. The fluid under pressure then travels through the feeder tubes 5*a* into the nozzles 5 from which the fluid is sprayed as Jets 10 to impinge upon the forward edges of labels 7 and foil tags 8 disposed on bottles 4.

Outside the periphery of the turntable 1 which supports the bottles 4, there is preferably an outer limiting wall 13 and stationary collector 11 for the labels 7 and foil tags 8 removed by the jets 10 and transported radially outward. The stationary collector 11 has a separator barrier 12, which separates the labels 7 and foil tags 8 occurring at different levels, and collection containers 14, 15 designed as ring-shaped troughs.

The placement of the separator barrier 12 creates separate paths for the labels 7 and foil tags 8 to follow and therefore enables a more effective separation of the labels 7 and foil tags 8 into collection containers 14, 15. The separator barrier 12 is preferably designed as having a member 12*b* and a deflector 12*a* which are disposed such that foil tags 8 removed from the top section of the bottle may be carried over over the top edge of the deflector 12*a* by the pressurized fluid from jets 10, and may impinge upon an outer limiting wall 13, before dropping into a first collection container 14. The labels 7 removed from the bottom section of the bottle 4, along with the pressurized fluid from the jets 10, may impinge upon the underside of the deflector 12*a* and then drop into a second collection container 15.

The bottoms of the collection containers 14, 15 are designed as screens 16, 17 so that the fluid released by the jets can be transported to a microfilter 18 and a pump 19 from where the fluid can be recycled back to the high pressure nozzles, described below in conjunction with FIG. 1*b*. The labels 7 and the foil tags 8, can be separated by type, and removed by hand or by mechanical conveyors (not shown) from the ring-shaped collection containers 14, 15. The labels 7 and foil tags 8 may then be pressed and recycled.

Figure 1B:
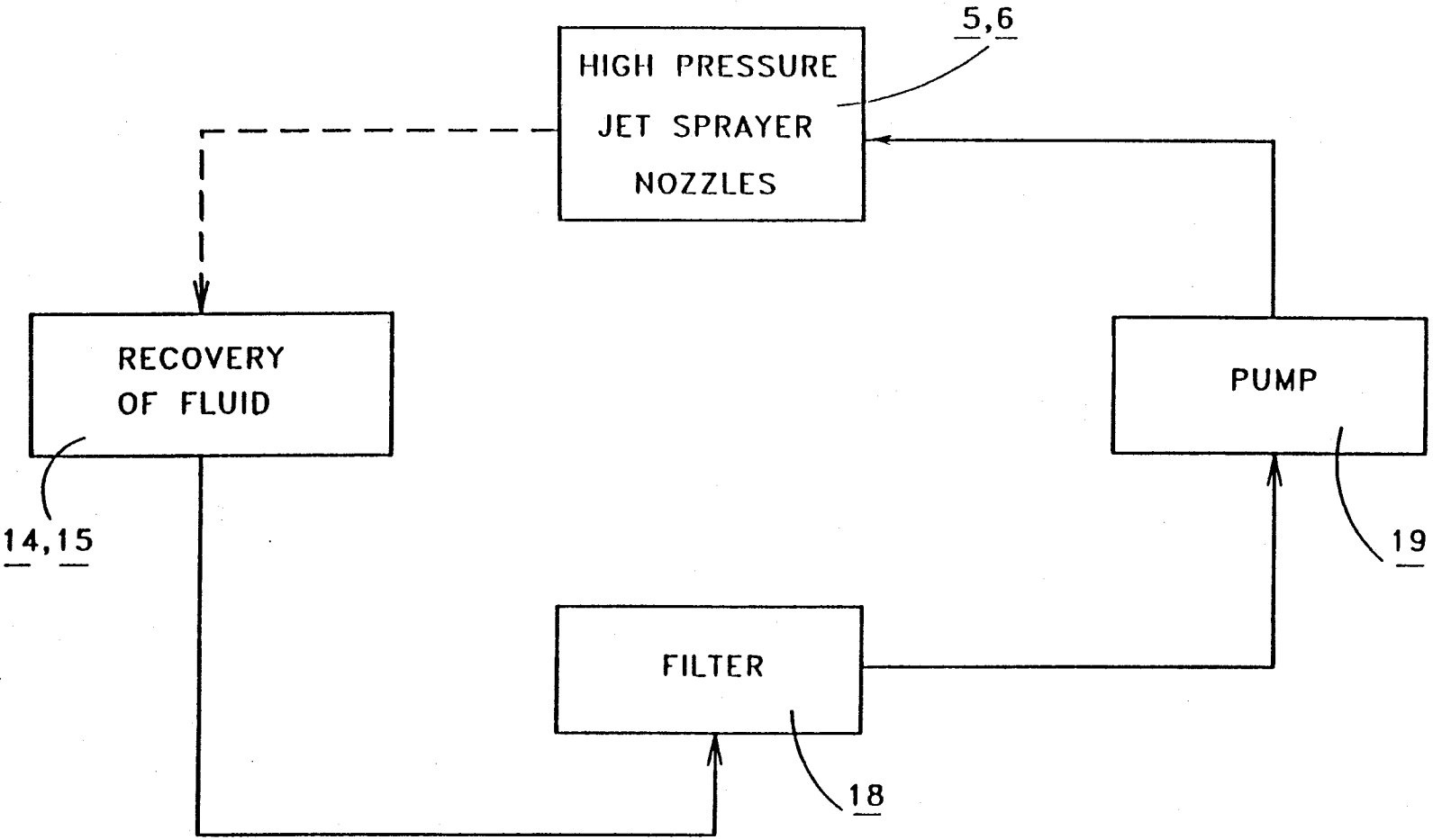
FIG. 1*b* is a block diagram showing several of the systems of the apparatus.

FIG. 1*b* depicts the movement of fluid through the label and foil removing apparatus, as described above. Washing fluid is sprayed through the high pressure jet sprayer nozzles 5, 6. After impacting the bottle, the fluid is recovered in the collection containers 14, 15. The fluid is then filtered in microfilter 18 wherein the pieces of the labels and foil tags are removed. After filtration, the fluid may then be pumped, by a pump 19, back into the the high pressure jet sprayer nozzles 5, 6 once again.

One high-pressure nozzle for each label will generally suffice whether the labels to be removed from the bottles have their edges exposed on both sides, or on a specified side. Since the bottle 4 rotates, the exposed edge in either case can be brought into the vicinity where the jet can strike the bottle. On the other hand, for labels and foil tags whose ends overlap in an unspecified manner, it may be necessary to locate a jet nozzle on both sides of each gripped bottle 4. This is to allow the exposed edge of the label to be brought into a position where the label faces one of the two jets. Alternatively, the direction of rotation of the bottles 4 could change during label removal, so that the bottle 4 could be rotated in a first direction, followed by rotation of the bottle in the opposite direction. This changing of directions could continue until the label is removed from the bottle.

An example of a high pressure nozzle system which may be used for the nozzle system of the present invention, can be found in U.S. Pat. No. 4,299,245 entitled "Filter Cleaning System."

The apparatus according to the invention can also be used for bottles which are labelled with a single label, i.e., which do not have a foil tag, in which case, the top high-pressure nozzle 6 is unnecessary. In this case, the second collection container 14 can be eliminated as well. The separator barrier 12 can also be eliminated if it is not necessary to separate labels and foil tags. In either case, the principle remains the same. The jets not only remove the labels and any foil tags, but also transport them radially outward to a collection container.

Figure 3:
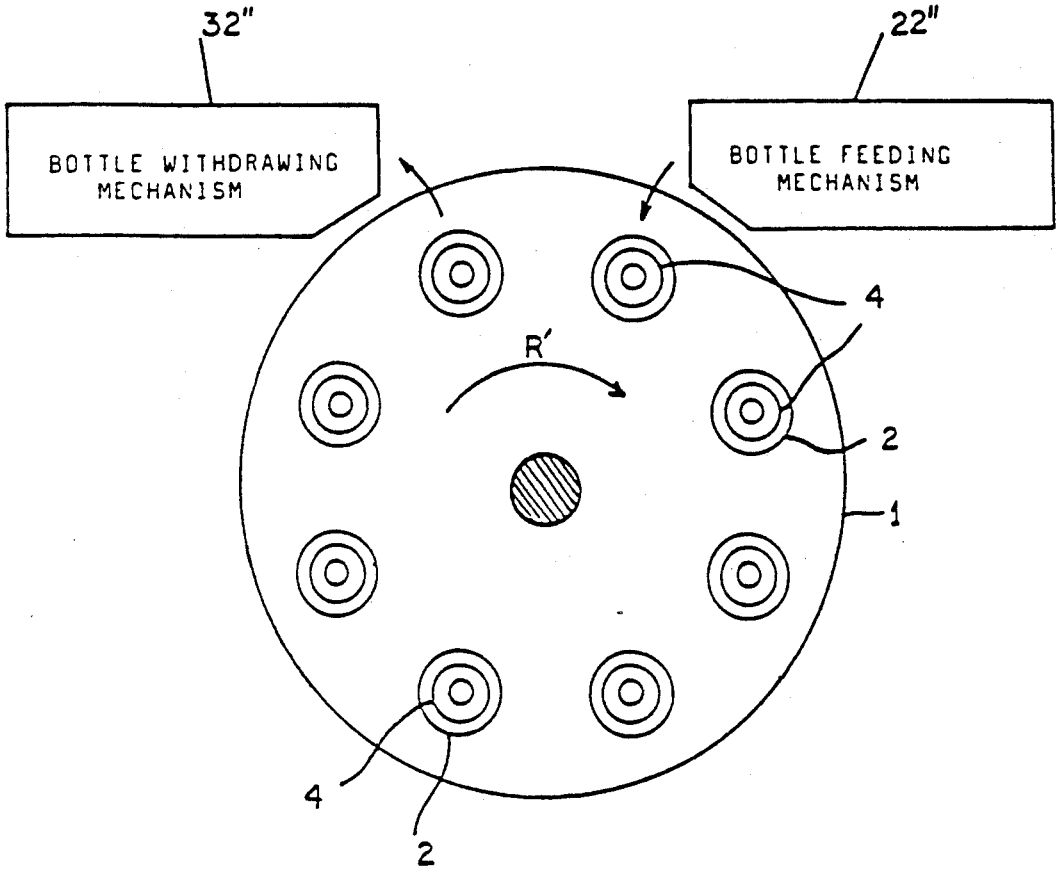
FIG. 3 is a schematic top view of the apparatus illustrated in FIG. 1.
Figure 4:
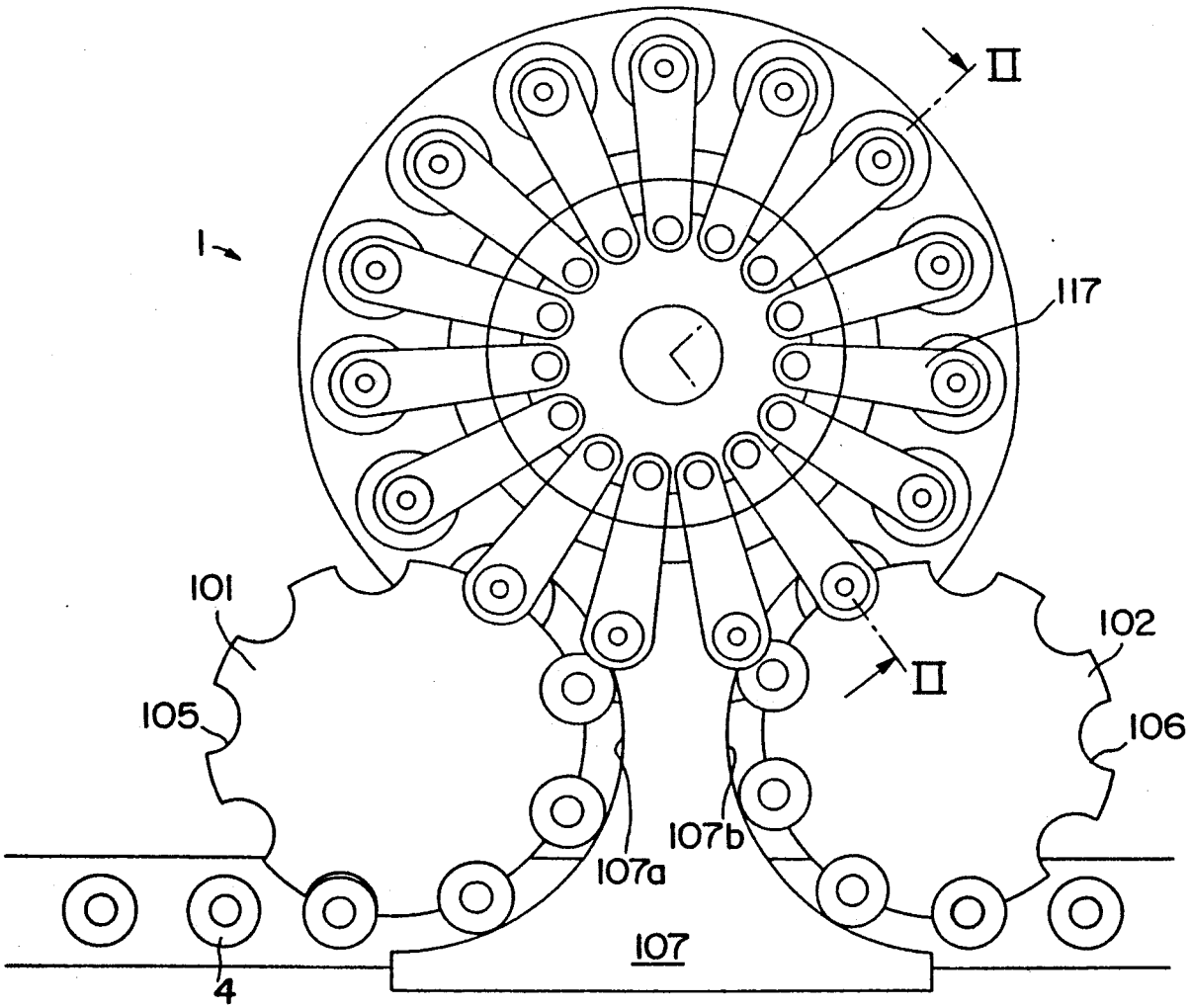
FIG. 4 is another schematic top view of the apparatus illustrated in FIG. 1, corresponding generally to FIG. 3, with additional structures included therein.

FIGS. 3 and 4 further illustrate an alternative embodiment for the inlet and outlet of bottles through the label removing apparatus of the present invention. In FIG. 3, a bottle 4 is positioned on a rotatable plate 2 by a bottle feeding mechanism 22''. Motion of rotation of the turntable 1, indicated by the arrow R', then moves the bottle 4 past a series of stations la, as shown in FIG. 2, whereat the labels and foil tags are removed. Such label removal stations 1*a* may reside at the interior portion of the turntable 1. The bottle 4 is then removed from the rotatable plate 2 by a bottle withdrawing mechanism 32''.

FIG. 4 depicts a feeder star wheel 101, a discharge star wheel 102, and a turntable 1 located therebetween. The feeder star wheel 101 and the discharge star wheel 102 have on their circumference, pockets 105 and 106 to hold the bottles 4 from which the labels are to be removed. Corresponding cam guides 107*a* and 107*b* of a guide element 107 are located between the feeder star wheel 101 and the discharge star wheel 102 so that the bottles 4 are held in the pockets 105 and 106.

Figure 5:
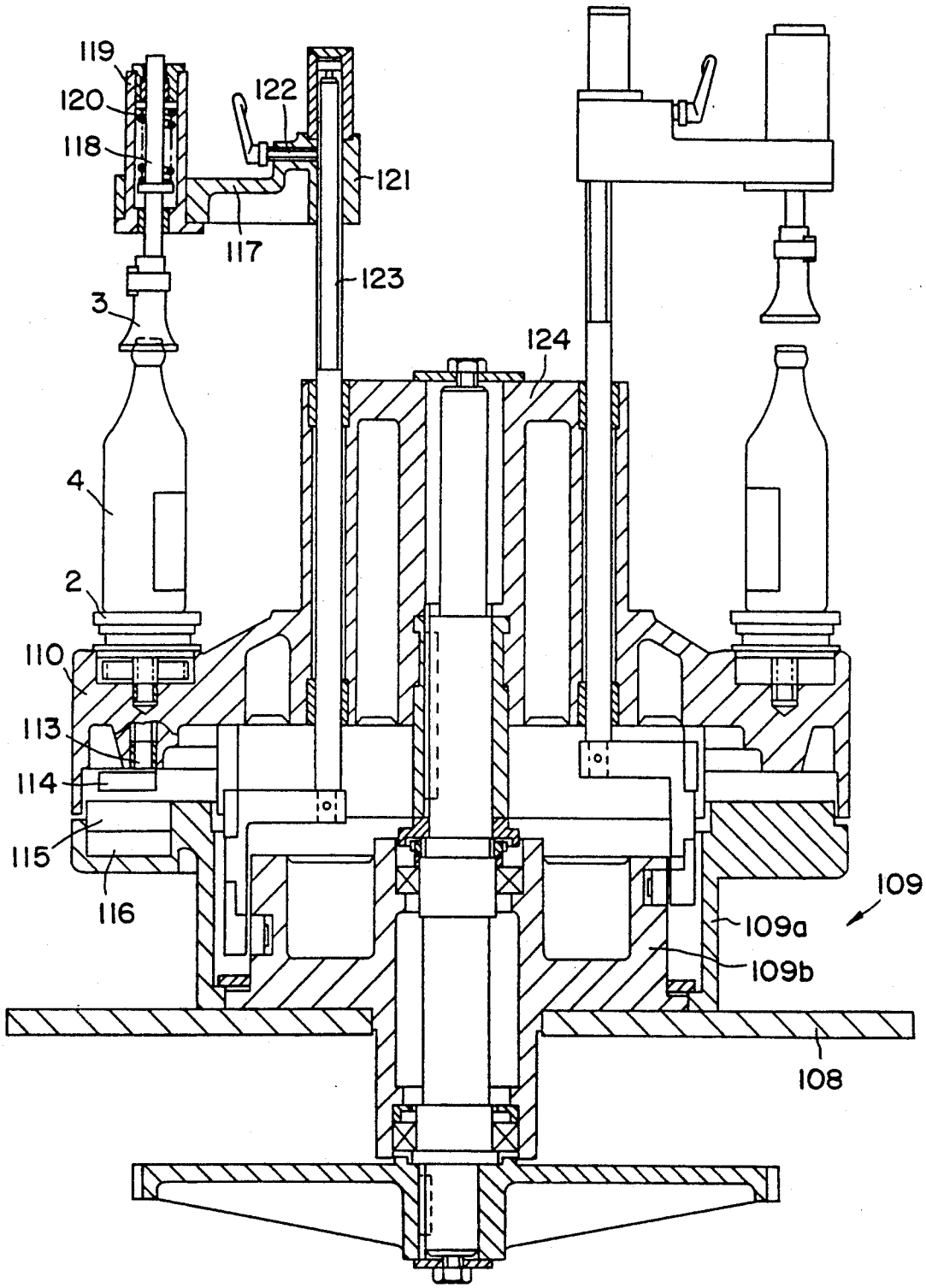
FIG. 5 is a side elevational view, partially in section, of the apparatus illustrated in FIG. 1, taken along the line II—II in FIG. 4.

Another embodiment of the turntable 1 is illustrated in FIG. 5. The turntable 1 may include a two-piece substructure 109, having substructure parts 109*a* and 109*b*, positioned on a table board 108 and a bottle support 110 mounted so that it can rotate on the substructure parts 109*a* and 109*b*. The substructure parts 109*a* and 109*b* of the substructure 109 may be adjustable independently of one another with respect to their rotary positions on the table board 108. Rotary plates 2 are preferably mounted on the bottle support 110. Gripping heads 3, corresponding to the rotary plates 2, are also preferably provided. The rotary plates 2 and the gripping heads 3 form receptacles for the bottles and brace the bottles axially while the labels are removed.

Each rotary plate 2 can be connected to a drive shaft 113, which drive shaft, generally by way of an interposed translation transmission, is connected to a lever arm 114. The lever arm 114 can be connected to the bidirectional motor 115 which has the control 116.

The system works such that when the bottle support 110 rotates, the bottle 4 is rotated past the label removing station located along the path so that a label is removed from the circumference of the bottle 4.

The gripping head 3 may be supported by a radial cantilever arm 117 through guide pin 118 in a guide bushing 119 so that the gripping head 3 can move axially against the force of a biasing spring 120. The spring 120 is generally compressed to exert axial elastic force and to compensate for tolerances in the dimensions of the bottles.

The cantilever arm 117, on the end away from the gripping head 3, generally has a guide bushing 121 that can be clamped in a stationary manner to a column 123 by a pulling bolt 122. The columns 123 of all the gripping heads 3 are preferably mounted in a common central guide body 124 that is part of the bottle support 110. The columns 123 can move axially in the guide body 124.

In summary, one feature of the invention resides broadly in an apparatus for the removal of labels 7 and foil tags 8 adhering to containers 4, in particular bottles, at different heights, the apparatus comprising a turntable 1 having an inlet and an outlet for the bottles 4. On the outer circumference of the turntable 1, the bottles 4 can be gripped between a powered rotary plate 2 and a gripping head 3, and removal elements 5 and 6 are located on the turntable 1 at an inner circumference relative to the bottles 4, which removal elements 5 and 6 act to remove the labels 7 and the foil tags 8 from the gripped bottles 4. This is characterized by the fact that the removal elements 5 and 6 are designed as high-pressure nozzles, whose essentially radially outward jets 10 strike the surface of the bottle 4 to be rotated essentially tangentially, such that as the bottle 4 rotates, its label 7 and foil tag 8 enter the vicinity of the jets 10 with their exposed forward edges facing the jets 10, and that on the outside circumference of the turntable there is a stationary collector 11 with an adjustable separator barrier 12 to separate the labels 7 and foil tags 8 collected at different heights which have been removed and transported radially outward by the jets 10.

Another feature of the invention resides broadly in an apparatus characterized by the fact that the rotary plates 2 are equipped for right-hand and left-hand operation, i.e., clockwise and counter-clockwise operation. There are two sets of high-pressure nozzles 5 and 6 for the gripping space of each bottle 4, one set of which operates during right-hand operation and the other set of which operates during left-hand operation.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

what is claimed is:

1. A method for completely removing at least one label from at least one container using an apparatus for the complete removal of the at least one label from the at least one container, providing nozzxle means for emitting fluid under pressure for complete removal of the at least one label from the at least one container; providing means for supplying fluid under pressure to the nozzle means; providing means for directing fluid under pressure from the nozzle means to a position at least partially underneath the at least one label of the at least one container; providing means for supporting at least one container during the complete removal of the at least one label from the at least one container; providing moving means for producing relative movement between the at least one container and the nozzle means; providing inlet means for supplying labelled containers for being impinged upon by fluid under pressure from the nozzle means; and providing outlet means for removing containers impinged upon by fluid under pressure from the nozzle means, the method comprising the steps of:

(a) emitting fluid under pressure from the nozzle means for complete removal of the at least one label from the at least one container;

(b) supplying fluid under pressure to the nozzle means;

(c) directing fluid under pressure from the nozzle means to a position at least partially underneath the at least one label of the at least one container and impinging said fluid under pressure from the nozzle means to a position at least partially underneath the at least one label of the at least one label;

(d) supporting the at least one container on the container supporting means during the complete removal of the at least one label from the at least one container;

(e) producing relative movement between the at least one container and the nozzle means for completely removing the at least one label from the at least one container;

(f) supplying labelled containers from being impinged upon by fluid under pressure from the nozzle means;

(g) removing containers impinged upon by fluid under pressure from the nozzle means;

wherein the moving means comprises means for rotating the at least one container, the nozzle means are disposed to impinge fluid under pressure, at an angle essentially tangential to the exterior surface of the at least one container, to a leading edge of rotation of the at least one label of the at least one container as the at least one container is rotated by said container supporting means, the method comprising the further steps of:

rotating the at least one container;

impinging fluid under pressure at an angle essentially tangential to the exterior surface of the at least one container and simultaneously impinging fluid under pressure on a leading edge of rotation of the at least one label of the at least one container as the at least one container is rotated; and wherein the means for supporting the at least one container comprises: container gripping means for gripping the at least one container comprising at least one of the following: a powered rotary plate, and a gripping head; and motor means for rotating said container gripping means in one of: a clockwise sense and a counter-clockwise sense, the method further comprising the steps of:

(a) gripping the at least one container with the container gripping means; and (b) rotating the container gripping means in one of: a clockwise sense and a counter-clockwise sense; and wherein the moving means for producing relative movement between the at least one container and the nozzle means comprises turntable means having an interior portion and an exterior portion, the exterior portion having an outside periphery; and the nozzle means being disposed on the interior portion of the turntable means and the container supporting means is disposed on the exterior portion of the turntable means; the inlet means comprises feeder star wheel means for supplying labelled containers to the exterior portion of the turntable means and the outlet means comprises discharge star wheel means for removing containers from the exterior portion of the turntable means, the method comprising the further steps of:

(a) disposing the nozzle means on the interior portion of the turntable means; and (b) disposing the container supporting means on the exterior portion of the turntable means.

2. A method for removing at least one label from at least one container according to claim 1, wherein the apparatus further comprising: collecting means for collecting fluid after the fluid impinges upon the at least one container, and the at least one label removed from the at least one container; filtering means for filtering fluid collected in the collecting means; and pumping means for pumping and pressurizing the filtered fluid into the nozzle means, the method comprising the further steps of:

(a) collecting fluid after the fluid impinges upon the at least one container;

(b) filtering fluid collected in the collecting means; and (c) pumping and pressurizing the filtered fluid into the nozzle means.

3. A method for removing at least one label from at least one container to claim 2, wherein the nozzle means comprises high pressure nozzles and the nozzle means is disposed for impinging fluid under pressure upon a foil tag on the at least one container, the method comprising the further steps of:

(a) disposing nozzle means for impinging fluid under pressure upon a foil tag on the at least one container; and (b) impinging fluid under pressure upon a foil tag on the at least one container.

4. A method for removing at least one label from at least one container according to claim 3, wherein the nozzle means comprises first nozzle means disposed for impinging fluid under pressure upon at least one first label of the at least one container and second nozzle means disposed for impinging fluid under pressure upon at least one second label of the at least one container; label separating means disposed for separating the at least one first label removed by the first nozzle means and the at least one second label removed by the second nozzle means: the label separating means is disposed along the outside periphery of the exterior portion of the turntable means, the method comprising the further steps of:

(a) disposing a first nozzle means for impinging fluid under pressure upon at least one first label of the at least one container;

(b) disposing a second nozzle means for impinging fluid under pressure upon at least one second label of the at least one container;

(c) impinging fluid under pressure from the first nozzle means upon at least one first label of the at least one container;

(d) impinging fluid under pressure from the second nozzle means upon at least one second label of the at least one container;

(d) disposing the label separating means along the outside periphery of the exterior portion of the turntable means; and (e) separating the at least one first label removed by the first nozzle means and the at least one second label removed by the second nozzle means.

5. A method for completely removing at least one label from at least one container using an apparatus for the complete removal of the at least one label from the at least one container, providing nozzle means for emitting fluid under pressure for complete removal of the at least one label from the at least one container; providing means for supplying fluid under pressure to the nozzle means; providing means for directing fluid under pressure from the nozzle means to a position at least partially underneath the at least one label of the at least one container; providing means for supporting at least one container during the complete removal of the at least one label from the at least one container; providing moving means for producing relative movement between the at least one container and the nozzle means; providing inlet means for supplying labelled containers for being impinged upon by fluid under pressure from the nozzle means; and providing outlet means for removing container impinged upon by fluid under pressure from the nozzle means, the method comprising the steps of:

(a) emitting fluid under pressure for the nozzle means for complete removal of the at least one label from the at least one container;

(b) supplying fluid under pressure to the nozzle means;

(c) directing fluid under pressure from the nozzle means to a position at least partially underneath the at least one label of the at least one container and impinging said fluid under pressure from the nozzle means to a position at least partially underneath the at least one label of the at least one label;

(d) supporting the at least one container on the container supporting means during the complete removal of the at least one label from the at least one container;

(e) producing relative movement between the at least one container and the nozzle means for completely removing the at least one label form the at least one container;

(f) supplying labelled containers for being impinged upon by fluid under pressure from the nozzle means; and (g) removing containers impinged upon by fluid under pressure from the nozzle means;

wherein said supporting of the at least one container on the container supporting means further comprises the steps of:

supporting a plurality of containers on the container supporting means; and providing at least one corresponding nozzle means for each of the plurality of containers supported on the container supporting means, said at least one corresponding nozzle means for each of the plurality of containers being for impinging said fluid under pressure against the corresponding container; and simultaneously impinging said fluid under pressure against at least two of said plurality of containers with at least one corresponding nozzle means for each of the plurality of containers.

6. A label removing apparatus for the removal of at least one label from at least one container, said apparatus comprising:

nozzle means being configured for emitting fluid under pressure from said nozzle means, said nozzle means being configured for impinging the fluid emitted under pressure onto the at least one label and the at least one container, said nozzle means further being configured for removing the at least one label from the at least one container by action of the fluid under pressure impinging the at least one label and the at least means for supplying fluid under pressure to said nozzle means;

means for directing fluid under pressure from said nozzle means to a position at least partially underneath the at least one label of the at least one container;

means for supporting the at least one container during removal of the at least one label from the at least one container;

moving means for producing relative movement between the at least one container and said nozzle means;

inlet means for supplying labelled containers for being impinged upon by fluid under pressure form said nozzle means; and outlet means for removing containers impinged upon by fluid under pressure from said nozzle means;

wherein said moving means comprises means for rotating the at least one container, said nozzles means are disposed to impinge fluid under pressure, at an angle essentially tangential to the exterior surface of the at least one container and simultaneously, impinge fluid under pressure on a leading edge of rotation of the at least one label of the at least one container as the at least one container is rotated by said container supporting means;

wherein said means for supporting the at least one container comprises:

container gripping means for gripping the at least one container comprising at least one of the following: a powered rotary plate, and a gripping head; and motor means for rotating said container gripping means in a clockwise sense and a counter-clockwise sense; and wherein said moving means for producing relative movement between the at least one container and said nozzle means comprises turntable means having an interior portion and an exterior portion, said exterior portion having an outside periphery; and said nozzle means being disposed on said interior portion of said turntable means.

7. A label removing apparatus for the removal of at least one label from at least one container, said apparatus comprising:

nozzle means being configured for emitting fluid under pressure from said nozzle means, said nozzle means being configured for impinging the fluid emitted under pressure onto the at least one label and the at least one container, said nozzle means further being configured for removing the at least one label from the at least one container by action of the fluid under pressure impinging the at least one label and the at least one container;

means for supplying fluid under pressure to said nozzle means;

means for directing fluid under pressure from said nozzle means to a position at least partially underneath the at least one label of the at least one container;

means for supporting the at least one container during removal of the at least one label from the at least one container;

moving means for producing relative movement between the at least one container and said nozzle means;

inlet means for supplying labelled containers for being impinged upon by fluid under pressure from said nozzle means; and outlet means for removing containers impinged upon by fluid under pressure from said nozzle means; and wherein said means for supporting the at least one container comprises means for supporting a plurality of containers, and said apparatus further comprises at least one corresponding nozzle means for impinging fluid under pressure against each of the plurality of containers being supported by said means for supporting.

8. A label removing apparatus for the removal of at least one label from at least one container, said apparatus comprising:

nozzle means being configured for emitting fluid under pressure from said nozzle means, said nozzle means being configured for impinging the fluid emitted under pressure onto the at least one label and the at least one container, said nozzle means further being configured for removing the at least one label from the at least one container by action of the fluid under pressure impinging the at least one label and the at least one container;

means for supplying fluid under pressure to said nozzle means;

means for directing fluid under pressure form said nozzle means to a position at least partially underneath the at least one label of the at least one container;

means for supporting the at least one container during removal of the at least one label from the at least one container;

moving means for producing relative movement between the at least one container and said nozzle means;

inlet means for supplying labelled containers for being impinged upon by fluid under pressure from said nozzle means; and outlet means for removing containers impinged upon by fluid under pressure from said nozzle means;

said nozzle means comprising first nozzle means disposed for impinging fluid under pressure upon at least one first label of the at least one container and second nozzle means disposed for impinging fluid under pressure upon at least one second label of the at least one container; and separating means disposed for separating the at least one first label removed by said first nozzle means and the at least one second label remove by said second nozzle means.

9. An apparatus for the removal of at least one label from at least one container, said apparatus comprising:

(a) nozzle means for emitting fluid under pressure and impinging the fluid onto the at least one container for removing the at least one label from the at least one container;

(b) means for supplying fluid under pressure to said nozzle means;

(c) means for directing fluid under pressure from said nozzle means to a position at least partially underneath the at least one label of the at least one container;

(d) means for supporting at least one container during removal of the at least one label from the at least one container;

(e) moving means for producing relative movement between the at least one container and said nozzle means, said moving means comprising; turntable means having an interior portion and an exterior portion, exterior portion having an outside periphery; and said nozzle means being disposed on the interior portion of said turntable means;

(f) inlet means for supplying labelled containers for being impinged upon by fluid under pressure form said nozzle means; and (g) outlet means for removing containers impinged upon by fluid under pressure from said nozzle means.

10. The label removing apparatus according to claim 9, wherein: said container supporting means is disposed on said exterior portion of said turntable means; said inlet means comprises feeder star wheel means for supplying labelled containers to said exterior portion of said turntable means; and said outlet means comprises discharge star wheel means for removing containers from said exterior portion of said turntable means.

11. The label removing apparatus according to claim 10, further comprising:

(a) collecting means for collecting fluid after the fluid impinges upon the at least one container;

(b) filtering means for filtering fluid collected in said collecting means; and (c) pumping means for pumping and pressurizing the filtered fluid into said nozzle means.

12. The label removing apparatus according to claim 11, wherein said nozzle means comprises high pressure nozzles.

13. The label removing apparatus according to claim 12, further comprising:

said nozzle means comprising first nozzle means disposed for impinging fluid under pressure upon at least one first label of the at least one container and second nozzle means disposed for impinging fluid under pressure upon at least one second label of the at least one container; and separating means disposed for separating the at least one first label removed by said first nozzle means and the at least one second label remove by said second nozzle means.

14. The label removing apparatus according to claim 13, wherein said label separating means is disposed along said outside periphery of said exterior portion of said turntable means.

* * * * *

UNITED STATES PATENT AND TRADEMARK OFFICE

CERTIFICATE OF CORRECTION

PATENT NO. : 5,217,538

DATED : June 8, 1993

INVENTOR(S) : Rainer BUCHHOLZ and Rudolf ZODROW

It is certified that error appears in the above-identified patent and that said Letters Patent is hereby corrected as shown below:

In column 9, line 20, Claim 1, after 'providing', delete "nozzxle" and insert --nozzle--.

In column 9, line 57, Claim 1, after 'containers', delete "from" and insert --for--.

In column 11, line 51, Claim 5, after 'removing', delete "container" and insert --containers--.

In column 11, line 54, Claim 5, after 'pressure', delete "for" and insert --from--.

In column 12, line 3, Claim 5, after 'label', delete "form" and insert --from--.

In column 12, line 37, Claim 6, after 'least', insert --one container;--.

UNITED STATES PATENT AND TRADEMARK OFFICE

CERTIFICATE OF CORRECTION

PATENT NO. : 5,217,538

DATED : June 8, 1993

INVENTOR(S) : Rainer BUCHHOLZ and Rudolf ZODROW

It is certified that error appears in the above-identified patent and that said Letters Patent is hereby corrected as shown below:

In column 12, line 51, Claim 6, after 'pressure', delete "form" and insert --from--.

In column 13, line 62, Claim 8, after 'pressure', delete "form" and insert --from--.

In column 14, line 43, Claim 9, after 'pressure', delete "form" and insert --from--.

Signed and Sealed this

Nineteenth Day of April, 1994

*Attest:*

Bruce Lehman

BRUCE LEHMAN

*Attesting Officer*

*Commissioner of Patents and Trademarks*